US010264925B2

(12) United States Patent
Eriksson

(10) Patent No.: US 10,264,925 B2
(45) Date of Patent: Apr. 23, 2019

(54) SHOWER PAN AND BATHTUB WITH CURVED OUTER EDGE AND ELEVATED THRESHOLD

(71) Applicant: INNOVATIVE LEAK SOLUTIONS, INC., Oxnard, CA (US)

(72) Inventor: Leonard Eriksson, Oxnard, CA (US)

(73) Assignee: INNOVATIVE LEAK SOLUTIONS, INC., Oxnard, CA (US)

( * ) Notice: Subject to any disclaimer, the term of this patent is extended or adjusted under 35 U.S.C. 154(b) by 11 days.

(21) Appl. No.: 15/423,854

(22) Filed: Feb. 3, 2017

(65) Prior Publication Data

US 2017/0215654 A1 Aug. 3, 2017

Related U.S. Application Data

(60) Provisional application No. 62/290,614, filed on Feb. 3, 2016.

(51) Int. Cl.
*A47K 3/40* (2006.01)
*A47K 3/02* (2006.01)

(52) U.S. Cl.
CPC . *A47K 3/40* (2013.01); *A47K 3/02* (2013.01)

(58) Field of Classification Search
CPC ..... A47K 3/40; A47K 3/02
USPC ..... 4/584
See application file for complete search history.

(56) References Cited

U.S. PATENT DOCUMENTS 2,122,245 A * 6/1938 Callahan ..... A47K 3/02 4/579
7,490,371 B2 * 2/2009 Torres ..... A47K 3/40 4/612

* cited by examiner

*Primary Examiner* — Tuan N Nguyen
(74) *Attorney, Agent, or Firm* — Risso I.P.

(57) ABSTRACT

Described is a prefabricated bathtub or shower pan with curved outer edges and an elevated threshold that act as returning points for water. More specifically, the bathtub or shower pan are formed to include a drain area surrounded by interior sides and a threshold dam. A side ledge is formed atop each of the interior sides, each side ledge having a top edge. Surrounding walls rise from the top edge of each side ledge. Further, the threshold dam has an angled top surface with a lower edge. Notably, the lower edge of the angled top surface is higher than the top edge of each of the side ledges to prevent any water from running from the side ledges onto the threshold dam. The bathtub or shower pan also include curved outer edges that transition from a side wall and onto the threshold dam to return water to the drain area.

7 Claims, 2 Drawing Sheets

SHOWER PAN AND BATHTUB WITH CURVED OUTER EDGE AND ELEVATED THRESHOLD

CROSS-REFERENCE TO RELATED APPLICATIONS

This is a non-provisional patent application of U.S. Provisional Application No. 62/290,614, filed on Feb. 3, 2016.

BACKGROUND OF THE INVENTION (1) Field of Invention

The present invention relates in general to shower pans and bathtubs, and more particularly, to a prefabricated shower pan and bathtub with curved outer, edges and an elevated threshold that act as returning points for water.

(2) Description of Related Art

Most shower pans and bathtubs are either custom-made or preformed with a common shape. Notably, preformed shower pans and bathtubs have thresholds on all four sides of the drain area that are of a common height. Thus, errant water on the front of the tub or shower pan is not immediately directed back toward the drain area.

Thus, a continuing need exists for a shower pan and bathtub that addresses the issues as presented in the prior art.

SUMMARY OF INVENTION

This disclosure is directed to a water enclosure formed as either a prefabricated bathtub or shower pan. The prefabricated bathtub or shower pan include curved outer edges and an elevated threshold that act as returning points for water. More specifically, the bathtub or shower pan are formed to include a drain area (having a drain hole) surrounded by connecting interior sides and a front threshold dam. A side ledge is formed atop each of the interior sides, each side ledge having a top edge. Surrounding walls rise from the top edge of each side ledge. Further, the front threshold dam has an angled top surface with a lower edge. Notably, the lower edge of the angled top surface is higher than the top edge of each of the side ledges to prevent any water from running from the side ledges onto the front threshold dam.

In another aspect, at least a portion of each side ledge is angled to descend away from the surrounding wall and toward the drain area.

In yet another aspect, the water enclosure also includes one or more curved outer edges that transition from a side wall and onto the, angled top surface of the front threshold dam.

The curved outer edges are curved returns having an inner return with a width formed to accommodate drywall or greenboard. The width of the inner return is between one quarter and three quarters of an inch. In another aspect, the width of the inner return is approximately half an inch.

Finally, as can be appreciated by one in the art, the present invention also comprises a method for forming and using/installing the invention described herein. For example, the method for using the bathtub or shower pan, includes an act of installing the bathtub or shower pan at a final site location (e.g., in a bathroom, etc.) Once installed, drywall or greenboard or any other suitable backing material is positioned on the prefabricated bathtub or shower pan such that the backing material is partially tucked within the inner return. Mud (e.g., cement, adhesive, etc.) can then be applied over the backing material. Finally, a final wall covering (e.g., tile, granite, etc.) is applied to cover the mud.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates in general to shower pans and bathtubs, and more particularly, to a prefabricated shower pan and bathtub with curved outer edges and an elevated threshold that act as returning points for water. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with, this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
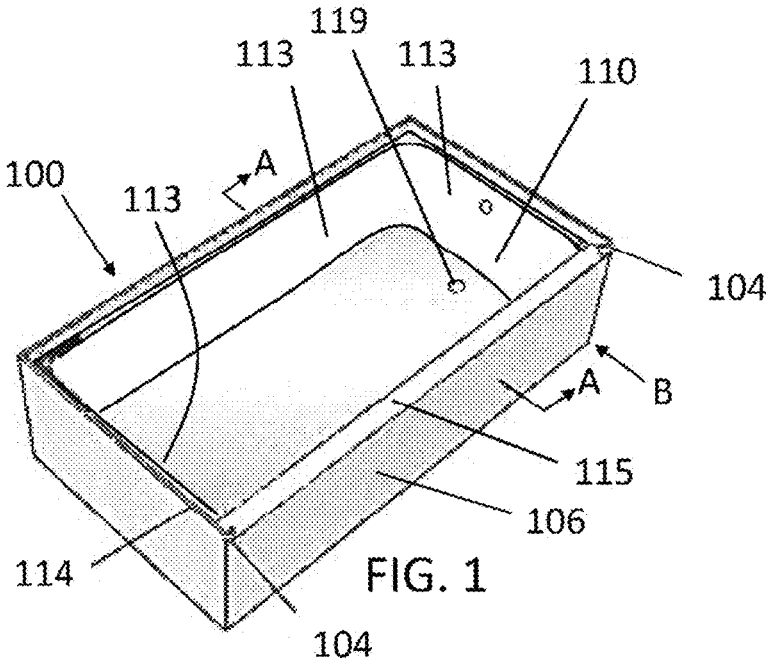
FIG. 1 is an illustration of a water enclosure formed in a bathtub configuration according to some embodiments of the present invention.
Figure 3:
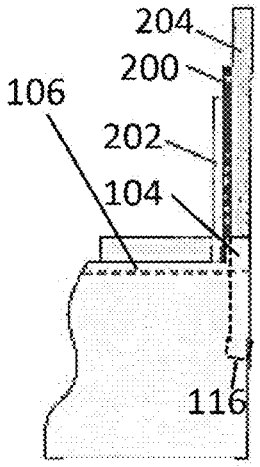
FIG. 3 is a front-view illustration taken from line B of FIG. 1.
Figure 2:
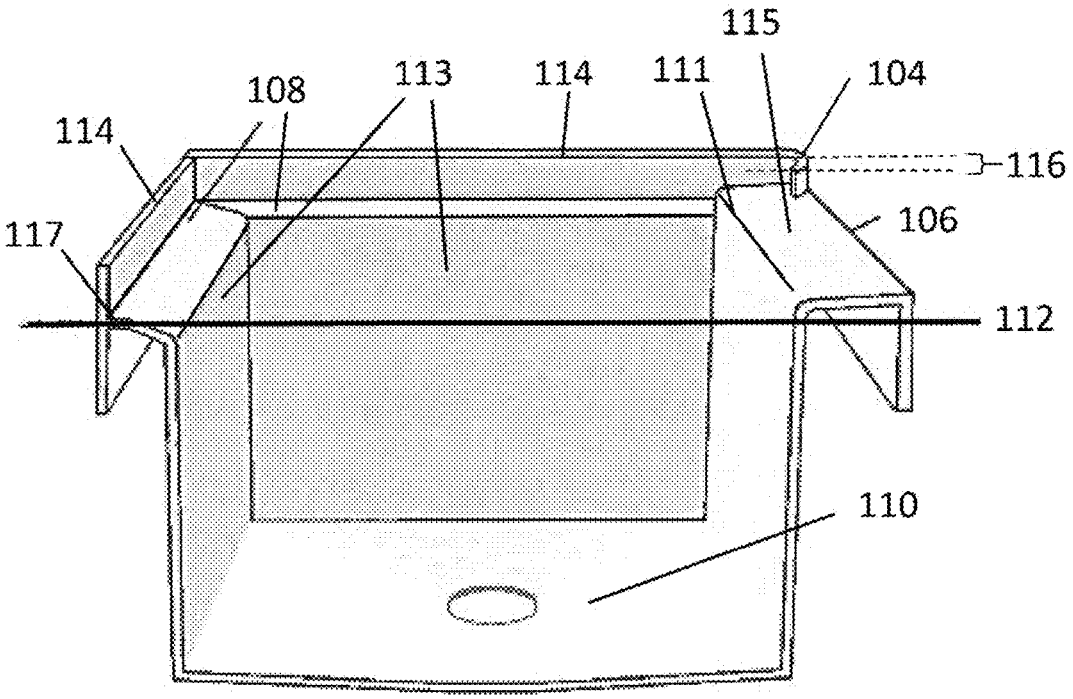
FIG. 2 is a cross-sectional view illustration taken from line A-A of FIG. 1.
Figure 4:
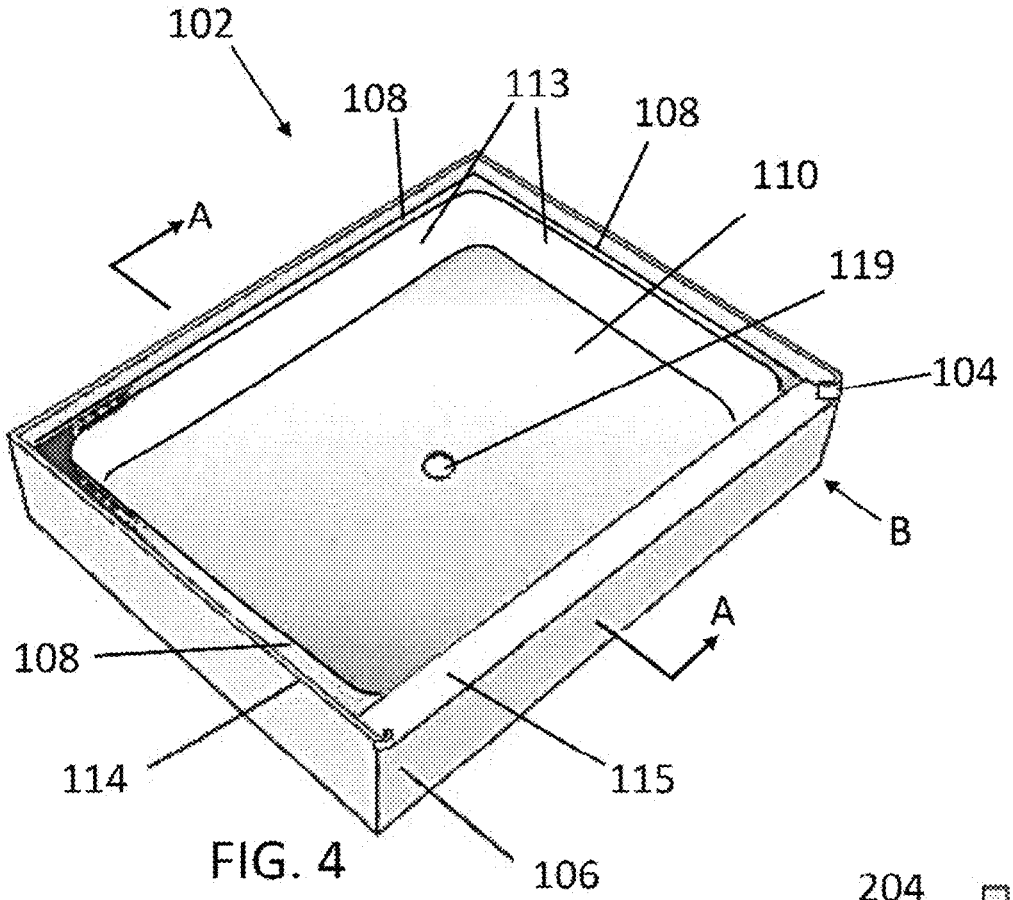
FIG. 4 is an illustration of a water enclosure formed in a shower pan configuration according to some embodiments of the present invention.
Figure 5:
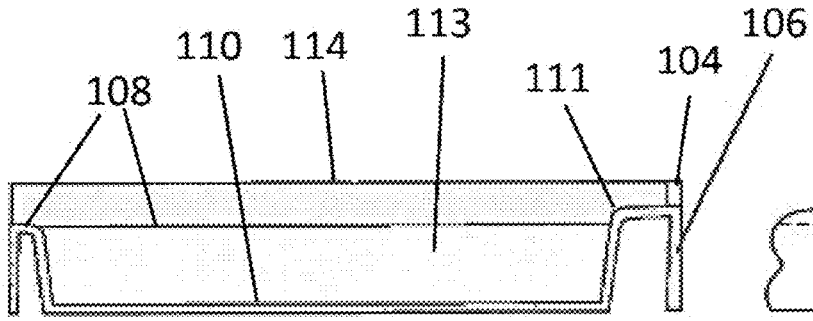
FIG. 5 is a cross-sectional view illustration taken from line A-A of FIG, 4.
Figure 6:
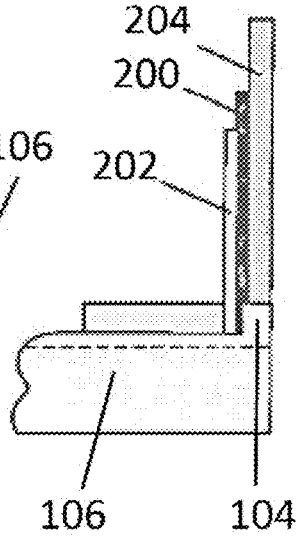
FIG. 6 is a front-view illustration taken from line B of FIG. 4.

The present invention is generally directed to prefabricated water enclosures. The water enclosures are prefabricated of any suitable material (e.g., fiberglass, porcelain, plastic, etc.) such that they are formed prior to site installation. More specifically, the water enclosures are prefabricated bathtubs and shower pans that serve to contain water in a bath or shower, respectively. As shown in FIGS. 1 through 6, this disclosure is directed to prefabricated bathtubs 100 and shower pans 102 with one or more curved outer edges 104 and an elevated threshold dam 106 that act as returning points for water. Specifically, FIG. 1 is an illustration of the water enclosure in a bathtub 100 configuration, while FIG. 2 is a cross-sectional view illustration taken from line A-A of FIG. 1, and FIG. 3 is a front view illustration taken from line B of FIG. 1. Similarly, FIG. 4 is an illustration of the water enclosure in a shower pan 102 configuration, while FIG. 5 is a cross-sectional view illustration taken from line A-A of FIG. 4 and FIG. 6 is a front-view illustration taken from line B of FIG. 4. In either configuration, the bathtub 100 and shower pan 102 are both formed to include the features as described herein and provided in further detail below.

As shown in the drawings, a drain area 110 is surrounded by connecting interior sides 113 (e.g., two, three, four, or more interior sides 113) and a front threshold dam 106. Notably, the front threshold dam 106 is higher than the side ledges 108 formed atop the other interior sides 113. The front threshold dam 106 acts as a damming point and returning point of the water to the drain area 110. This aspect is clearly depicted in FIG. 2 with the superimposed level line 112, which illustrates that the lower edge 111 of the angled top surface 115 of threshold dam 106 is higher than the top edge 117 of the side ledges 108. Thus, the front threshold dam 106 is elevated with respect to the side ledges 108. As a non-limiting example, the lower edge 111 is one inch higher than the top edge 117 of the side ledges 108 (or any other desired dimension so long as water is unable to freely run from the side ledges 108 up onto the threshold dam 106). Because the front threshold dam 106 is higher than the side ledges 108, any water that may run along the side ledges is prevented from escaping the water enclosure (i.e., bathtub 100 or shower pan 102) and returned to the drain area 110 and its corresponding drain hole 119. The ability to prevent water from escaping is assisted by surrounding walls 114 that rise from the top edge of the side ledges 108. In some aspects, portions of the side ledges 108 are relatively horizontal or level with respect to a ground surface and then angle to descend away from the corresponding side wall 114 toward the drain area 110. In other aspects, the entirety of the side ledges 108 are angled to descend away from the corresponding side wall 114 toward the drain area 110. In either case, the side ledges 108 are sufficiently deep (e.g., one inch deep, or any other depth as desired) such that they can accommodate and support tile or other wall overlays that are placed in a bathtub or shower enclosure.

Also shown in the figures are the curved outer edges 104. The curved outer edges 104 are formed as curved walls that transition from the side walls 114 and onto the front threshold dam 106 (the top surface 115 of which is angled toward the drain area 110). As shown in FIGS. 3 and 6, the curved outer edges 104 allow mud 200 and tile 202 to be laid behind the curved outer edge 104 such that water dripping down the tile 202 is dammed by the curved outer edge 104 and directed back to threshold dam 106 and then the corresponding drain area 110. As shown in FIGS. 2 and 3, the curved outer edges 104 are curved returns having an inner return of any desired width 116 to accommodate a variety of materials. As a non-limiting example, the width 116 of the inner return is between one quarter and three quarters of an inch (i.e., common widths of drywall or greenboard 204). In yet another aspect, the width 116 is approximately one half an inch, which is a desired thickness of the drywall or greenboard 204. Thus and as can be appreciated by those skilled in, the art, the curved outer edge 104 is formed to wrap around a wall material (e.g., drywall or greenboard 204, etc.) and direct water back toward the front threshold dam 106. Because the front threshold dam 106 is angled toward the drain area 110 water is prevented from escaping the water enclosure.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A water enclosure for use as a bathtub or shower pan for containing water and directing water to a drain area, comprising:

a drain area surrounding by connecting interior sides and a front threshold dam, the drain area having a drain hole formed therethrough;

wherein a side ledge is formed atop each of the interior sides, each side ledge having a top edge;

wherein surrounding walls rise from the top edge of each side ledge;

wherein the front threshold dam has an angled top surface with a lower edge; and wherein the lower edge of the angled top surface is higher than the top edge of each of the side ledges; and one or more curved outer edges that transition from a surrounding wall and onto the angled top surface of the front threshold dam, wherein the curved outer edges are curved returns having an inner return with a width between one quarter and three quarters of an inch.

2. The water enclosure as set forth in claim 1, wherein the water enclosure is formed as a prefabricated shower pan or bathtub.

3. The water enclosure as set forth in claim 2, wherein at least a portion of each side ledge is angled to descend away from the surrounding wall and toward the drain area.

4. The water enclosure as set forth in claim 3, wherein the width of the inner return is approximately half an inch.

5. The water enclosure as set forth in claim 1, wherein at least a portion of each side ledge is angled to descend away from the surrounding wall and toward the drain area.

6. The water enclosure as set forth in claim 1, wherein the width of the inner return is approximately half an inch.

7. A method for installing a water enclosure for use as a bathtub or shower pan for containing water and directing water to a drain area, comprising acts of:

installing a prefabricated bathtub or shower pan at a final site location, the prefabricated bathtub or shower pan having:

a drain area surrounding by connecting interior sides and a front threshold dam, the drain area having a drain hole formed therethrough;

wherein a side ledge is formed atop each of the interior sides, each side ledge having a top edge;

wherein surrounding walls rise from the top edge of each side ledge;

wherein the front threshold dam has an angled top surface with a lower edge;

wherein the lower edge of the angled top surface is higher than the top edge of each of the side ledges;

one or more curved outer edges that transition from a surrounding wall and onto the angled top surface of the front threshold dam;

wherein the curved outer edges are curved returns having an inner return with a width formed to accommodate drywall or greenboard, the width being between one quarter and three quarters of an inch; and positioning drywall or greenboard on the prefabricated bathtub or shower pan such that the drywall or greenboard is partially tucked within the inner return;

apply mud over the drywall or greenboard; and applying a final wall covering over the mud.

* * * * *